US005980291A

United States Patent [19]

Ono

[11] Patent Number: 5,980,291

[45] Date of Patent: Nov. 9, 1999

[54] CONNECTOR

[75] Inventor: Junichi Ono, Nagoya, Japan

[73] Assignees: Harness System Technologies Research Ltd., Aichi; Sumitomo Wiring Systems, Ltd., Mie; Sumitomo Electric Industries, Ltd., Osaka, all of Japan

[21] Appl. No.: 08/957,770

[22] Filed: Oct. 24, 1997

[30] Foreign Application Priority Data

Oct. 31, 1996 [JP] Japan ..... 8-290791

[51] Int. Cl.[6] ..... H01R 13/64

[52] U.S. Cl. ..... 439/247; 439/544

[58] Field of Search ..... 439/246–248, 439/527, 533, 544, 545, 552–3, 556, 555, 557, 575

[56] References Cited

U.S. PATENT DOCUMENTS

| | | | |
|---|---|---|---|
| 5,259,779 | 11/1993 | Ooya et al. | 439/247 |
| 5,514,000 | 5/1996 | Krause et al. | 439/248 |
| 5,575,673 | 11/1996 | Dahlem et al. | 439/248 |
| 5,775,944 | 7/1998 | Flask et al. | 439/556 |
| 5,800,208 | 9/1998 | Ishizuka et al. | 439/557 |

FOREIGN PATENT DOCUMENTS

| | | |
|---|---|---|
| 64-27982 U | 2/1989 | Japan . |
| A 8-31510 | 2/1996 | Japan . |

*Primary Examiner*—Lincoln Donovan
*Attorney, Agent, or Firm*—Oliff & Berridge PLC

[57] ABSTRACT

A connector for connection to a mating connector in such a manner that said connector is attached to a fixing member, said connector comprising: a connector housing for connection to said mating connector; a fixing portion for being attached to said fixing member; and connecting portions interconnecting said connector housing and said fixing portion, wherein said connector housing, said fixing portion and said connecting portions are integrally formed of an elastically-deformable material, and each of said connecting portions has a first flexing portion extending in a first direction substantially perpendicular to a direction of connection of said connector to said mating connector, and a second flexing portion extending in a second direction substantially perpendicular to said direction of connection to said mating connector and said first direction.

5 Claims, 6 Drawing Sheets

CONNECTOR

BACKGROUND OF THE INVENTION

1. Field of the Invention

This invention relates to a connector used for electrically connecting electric units together.

2. Description of the Related Art

Generally, a connector is used for electrically connecting electric units together (for example, for electrically connecting a body of a vehicle and an instrument panel). For example, for interconnecting two units, connectors are provided on these units, respectively, and the two units are electrically connected together by connecting the connectors together.

In one proposed method of connecting the connectors together, the connectors are beforehand fixed to the units, respectively, and the position of fixing of each connector to the associated unit is so determined that housings of the two connectors can be fitted together when interconnecting the two units.

In this method, however, if there is even a slight error in the position of mounting of the connector on the associated unit, it is possible that the two connectors fail to be connected together. And besides, even if each connector is mounted in position on the associated unit, it is very difficult to interconnect the first and second units while properly fitting the housings of the two connectors together. Therefore, there are occasions when two units are often forcibly connected together although the two housings are not properly fitted together, so that the connector housing may be damaged.

Therefore, there have heretofore been proposed various constructions in which one connector is fixed to one unit in an ordinary manner whereas the other connector is mounted on the other unit in such a manner that this connector is displaceable relative to the one unit in a direction perpendicular to a connector-connecting direction (see Japanese Utility Model Unexamined Publication No. 64-27982).

One such example is shown in FIG. 7. In this Figure, a first connector C3, having a female housing, is completely fixed to a first unit U1, and a second connector C4, having a male housing, is so mounted on a second unit U2 that it can be displaced in a direction perpendicular to a connector-connecting direction (in an upward-downward direction in the drawing). More specifically, a flange 90 is formed at a proximal end of the housing of the second connector C4, and a holder portion 92, holding the flange 90, is formed on the second unit U2. Springs 94 are provided inwardly of the holder portion 92, and the connector C4 is held in position by the resiliency of the springs 94.

In this construction, even if there is a slight error in the position of fixing of the first connector C3 in the first unit U1 or in the position of holding of the second connector C4 in the second unit U2, this error can be absorbed by the displacement of the second connector C4 against the resiliency of the springs 94.

In the above construction, the second unit U2 must be formed into a complicated shape so that the second connector to C4 can be displaceably mounted on the second unit U2. And besides, the springs 94 must be provided in order to hold the second connector C4 in a neutral position, and therefore there are encountered disadvantages that the number of the component parts is increased and that the mounting operation is complicated.

SUMMARY OF THE INVENTION

With the above problems in view, it is an object of this invention to provide a connector in which a connector housing can be easily mounted displaceably on a fixing member such as a unit, using a simple construction requiring a reduced number of component parts.

The above object of the invention has been achieved by a connector for connection to a mating connector in such a manner that said connector is attached to a fixing member, said connector including: a connector housing for connection to said mating connector; a fixing portion for being attached to said fixing member; and connecting portions interconnecting said connector housing and said fixing portion, wherein said connector housing, said fixing portion and said connecting portions are integrally formed of an elastically-deformable material, and each of said connecting portions has a first flexing portion extending in a first direction substantially perpendicular to a direction of connection of said connector to said mating connector, and a second flexing portion extending in a second direction substantially perpendicular to said direction of connection to said mating connector and said first direction.

In this connector, the first flexing portion can be elastically deformed in a direction perpendicular to the first direction, and the second flexing portion can be elastically deformed (or flexed) in a direction perpendicular to the second direction, and therefore the connector housing can be displaced relative to the fixing portion in these flexing directions. Therefore, merely by fixing the fixing portion to the fixing member, the connector housing can be mounted for displacement relative to the fixing portion.

Preferably, displacement limitation portions for limiting the displacement of the connector housing in a direction parallel to the direction of connection to the mating connector are provided at the fixing portion. With this construction, the connector housing will not be excessively displaced in the direction parallel to the connector-connecting direction by a load applied when connecting the connector to the mating connector, and hence the connecting portions will not be excessively deformed in this direction, so that the connecting portions are prevented from damage due to such deformation.

The fixing portion may have any suitable shape, but when the fixing portion has a frame-like shape, and surrounds the connector housing, the overall size of the connector can be reduced since the connector housing is disposed within the fixing portion.

In this case, limitation windows are formed in a side wall of the fixing portion, and part of the connector housing or at least part of the connecting portions is received in the limitation window, and with this simple construction, the displacement of the connector housing in the direction parallel to the direction of connection to the mating connector is prevented by contact of a peripheral edge of the limitation window with the connector housing or the connecting portion.

In this case, cavities for molding the connecting portions can be used as the limitation windows, respectively, and with this arrangement, the overall construction of the connector can be more simplified, and the molding of the connector can be effected easily.

DETAILED DESCRIPTION OF THE PREFERRED EMBODIMENTS

One preferred embodiment of the present invention will now be described with reference to FIGS. 1 to 6. In this embodiment, a connector C1 of the invention is mounted on a body 10 of an automobile, and a mating connector C2 is mounted on a panel 12 fixedly secured to the body 10. However, the present invention is not limited to such a construction, but can be applied to various units or the like requiring an electrical connection.

Figure 1:
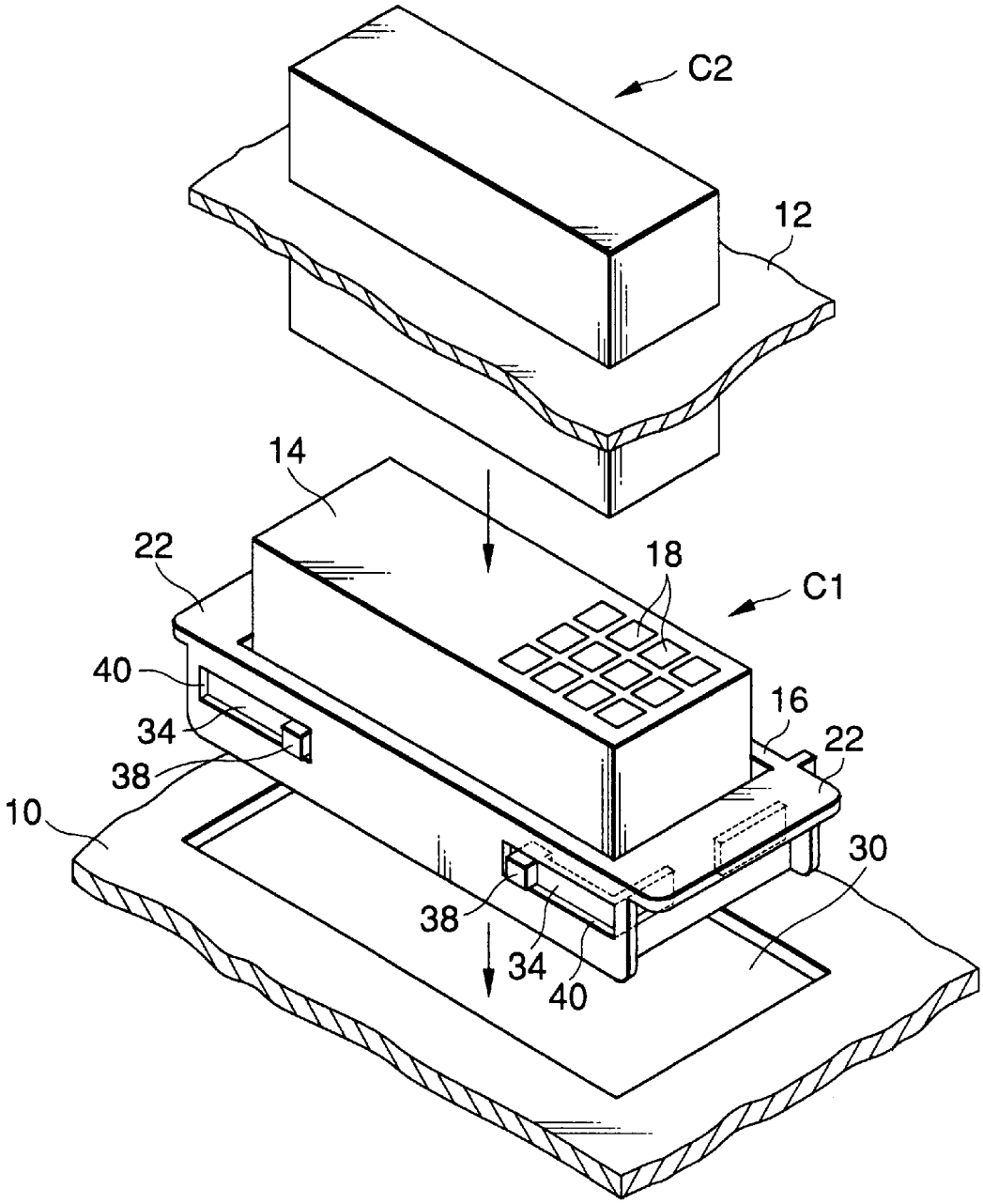
FIG. 1 is a perspective view showing a preferred embodiment of a connector of the invention and a mating connector.

As shown in FIG. 1, the mating connector C2 extends through and is fixedly secured to the panel 12. Many connector terminals (not shown) project from a connecting surface (lower surface in FIG. 1) of the mating connector C2.

As best shown in FIGS. 2 to 5, the connector C1 of the invention includes a connector housing 14, a fixing portion 16, connecting arms (connecting portions) 34 interconnecting the connector housing 14 and the fixing portion 16, and these parts are molded into an integral construction, using an elastically-deformable material such as a synthetic resin.

In this embodiment, the connector housing 14 has a substantially rectangular parallelepiped shape, and has many terminal receiving holes 18 respectively receiving connector terminals 20 (FIG. 2) which can be fitted relative to the connector terminals of the mating connector C2, respectively.

The fixing portion 16 has a frame-like shape, and surrounds the connector housing 14. A pair of ear portions 22 extend outwardly respectively from opposite sides of the fixing portion 16 which are spaced from each other in a longitudinal direction (that is, an X-axis direction in FIG. 2; a second direction) at an upper end thereof, and projections 24 are projectingly formed on a lower surface of each of the ear portions 22. A tongue 26 is formed on a lower portion of each of the X-axis opposite sides, and extends upwardly, and an outwardly-directed projection 28 is formed on an upper end of the tongue 26. A mounting hole 30 is formed through a panel of the body 10 in a direction of the thickness of this panel, and the fitting portion 16 is fitted in this mounting hole 30, with a peripheral edge portion of the mounting hole 30 held between the projections 24 and the projections 28 of the tongues 26, thus fixing the fixing portion 16 to the body 10. The position of the mounting hole 30 (that is, the position of fixing of the fixing portion 16) is so determined that when fixing the panel 12 to the body 10, the two connectors C1 and C2 can be disposed substantially in registry with each other.

Figure 2:
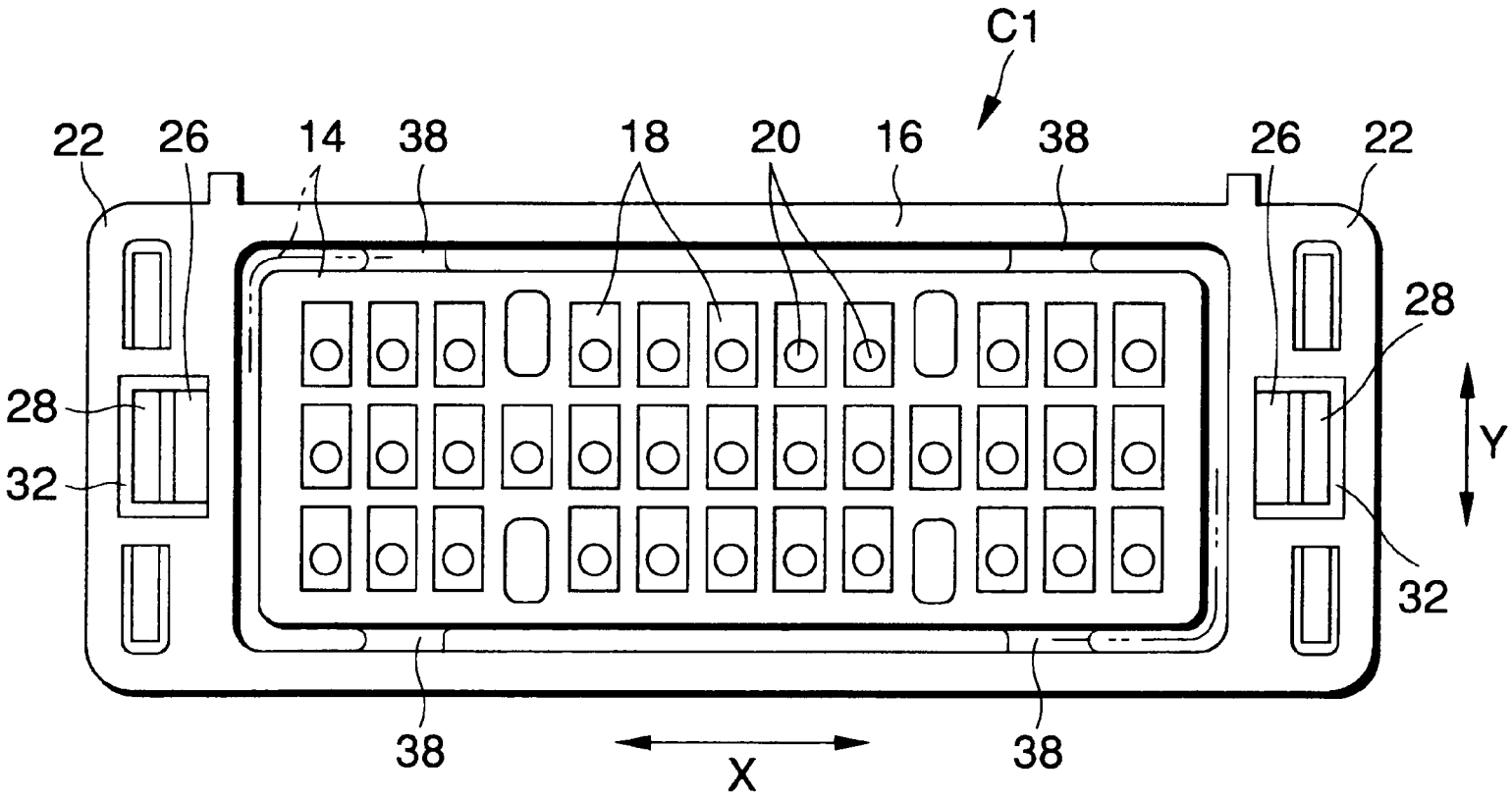
FIG. 2 is a plan view of the connector of the invention of FIG. 1.
Figure 3:
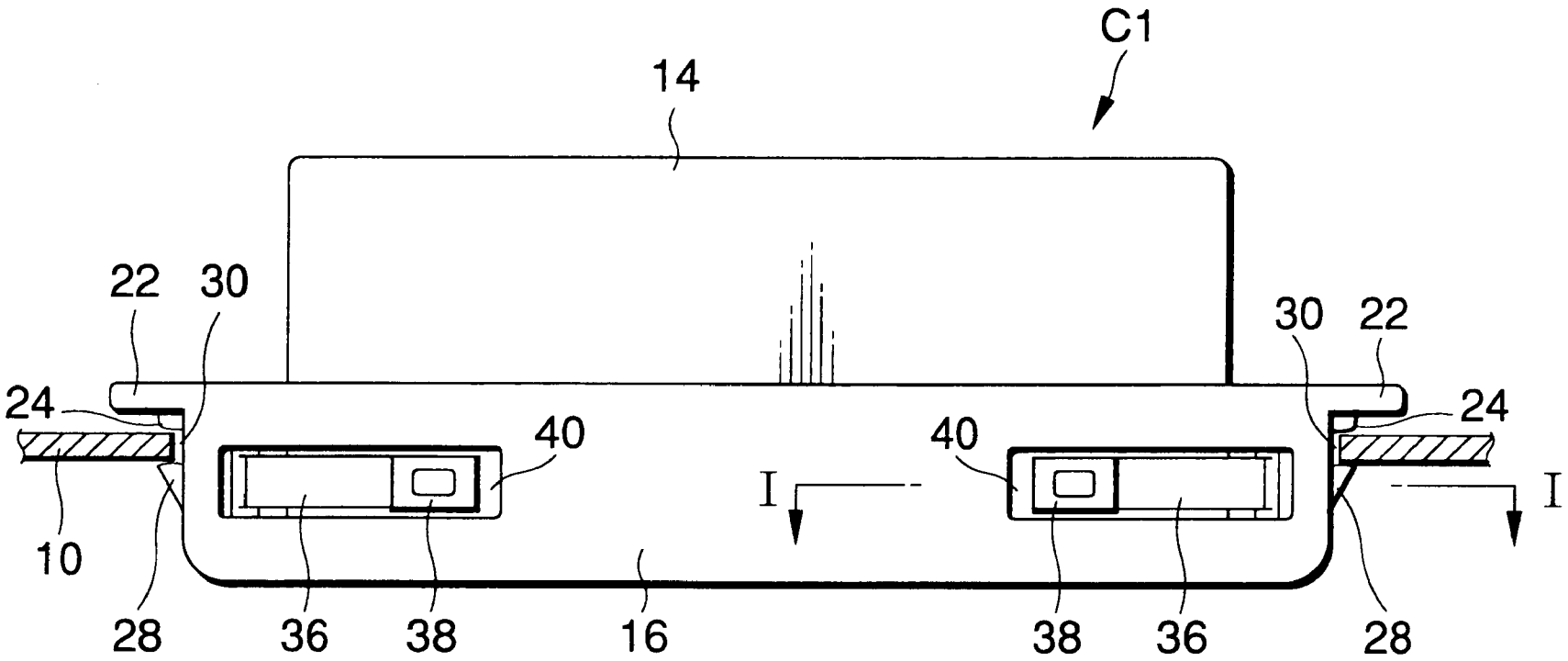
FIG. 3 is a front-elevational view of the connector of FIG. 2.
Figure 4:
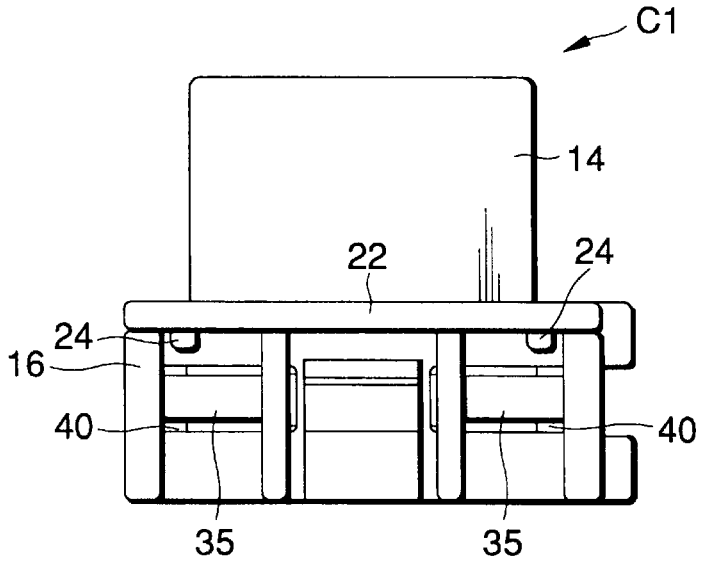
FIG. 4 is a side-elevational view of the connector of FIG. 2.

In FIG. 2, reference numeral 32 denotes cavities formed when molding the tongues 26.

Figure 5:
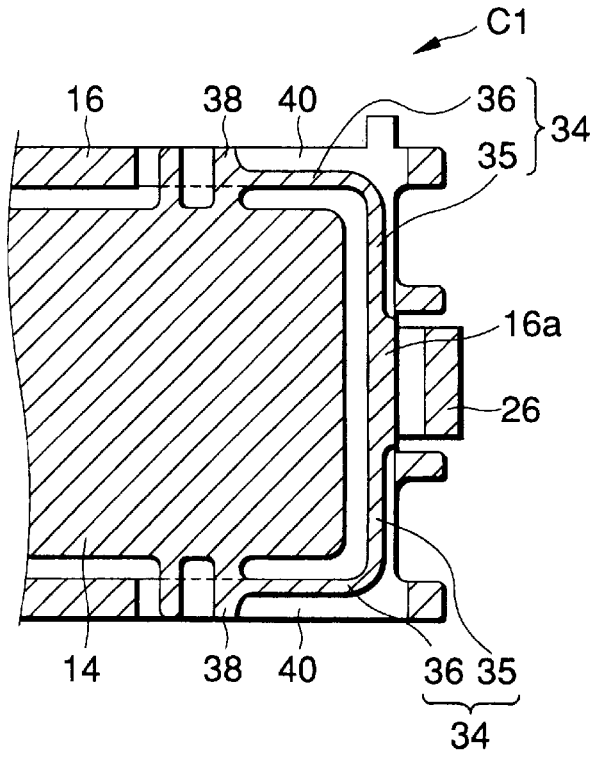
FIG. 5 is a cross-sectional view taken along the line I—I of FIG. 3.

Limitation windows 40 are formed respectively through four corner portions of a side wall of the fixing portion 16 in a direction of the thickness of this side wall, each of the limitation windows 40 having a substantially L-shape in a horizontal cross-section (FIG. 5). The connecting arms 34 are disposed respectively within the limitation windows 40. In other words, cavities for molding the connecting arms 34 serve as the limitation windows 40. Each of the connecting portions 34 has a first thin flexing portion 35 extending from a central portion 16*a* of the X-axis side of the fixing portion 16 (which is disposed adjacent to the limitation window 40) in a direction of the width of the fixing portion 16 (that is, a Y-axis direction of FIG. 2 perpendicular to the X-axis direction; a first direction), and a second flexing portion 36 extending from a distal end of this first flexing portion 35 toward a central portion in the X-axis direction (in a left-hand direction in FIG. 5), and the two flexing portions 35 and 36 are integral with each other. Namely, the connecting portion 34 has an L-shape, and extends along the associated window 40. Each of the second flexing portions 36 is connected to a corresponding one of projected portions 38 formed on opposite sides of the connector housing 14 spaced from each other in the Y-axis direction, and the projected portion 38 and the connecting portion 34 are received in the associated window 40.

Each first flexing portion 35 and each second flexing portion 36 do not need to extend accurately in the Y-axis direction and X-axis direction, respectively, but may be slightly inclined relative to the Y-axis direction and the X-axis direction, respectively.

Figure 6A:
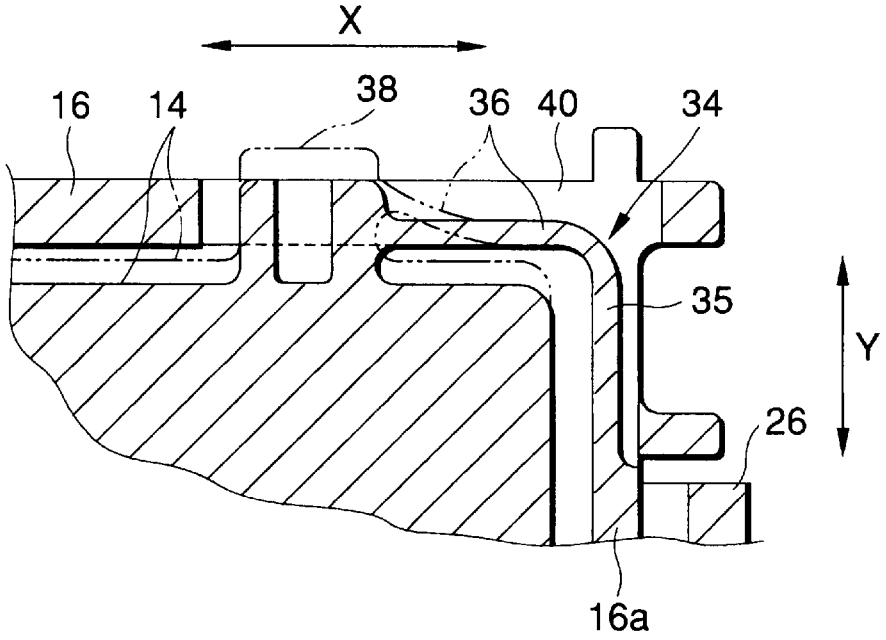
FIG. 6A is a horizontal cross-sectional view showing a condition in which a connector housing of the connector of FIG. 2 is displaced in a Y-axis direction.
Figure 6B:
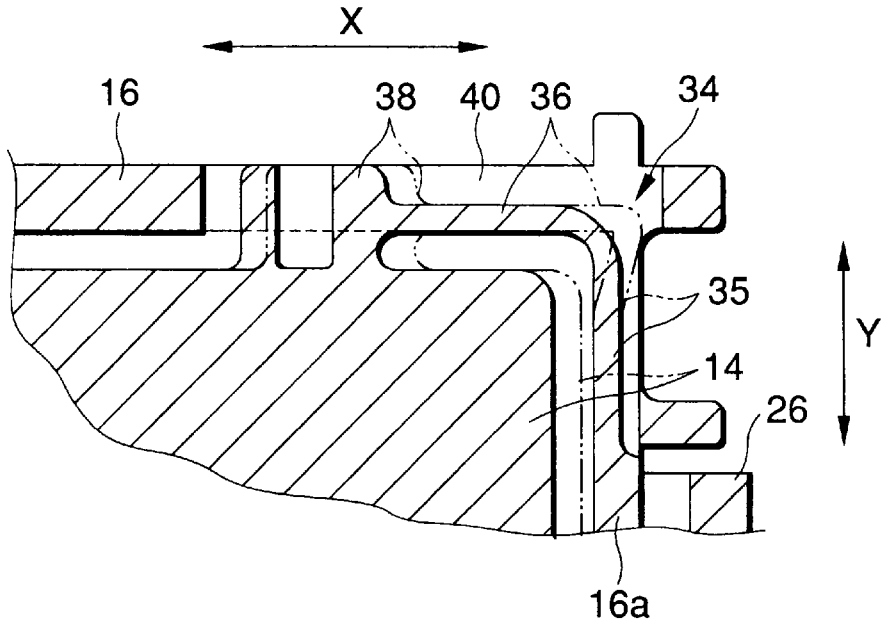
FIG. 6B is a cross-sectional view showing a condition in which the connector housing is displaced in an X-axis direction.
Figure 7:
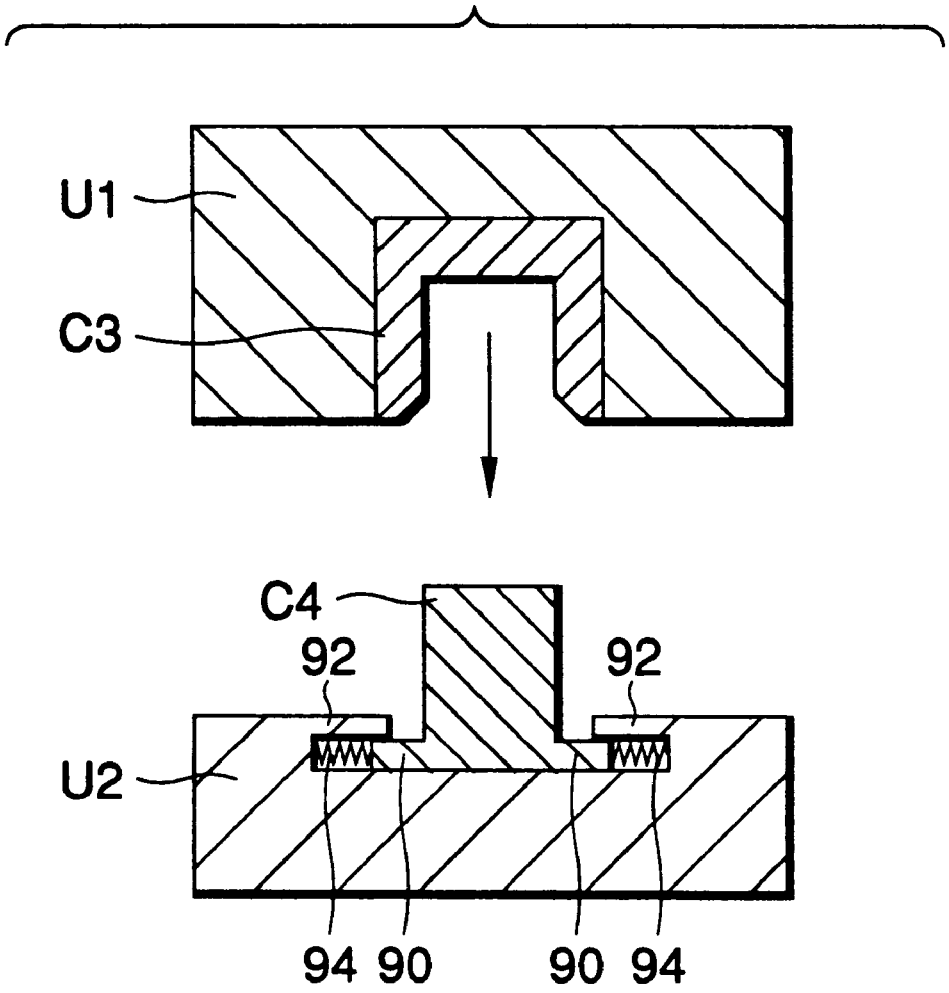
FIG.7 (RELATED ART)
FIG. 7 is a cross-sectional view showing a conventional connector.

In this connector C1, the second flexing portions 36 can be flexed in the Y-axis direction as shown in FIG. 6A, so that the connector housing 14 can be displaced relative to the fixing portion 16 (that is, relative to the body 10) in the Y-axis direction. The first flexing portions 35 can be flexed in the X-axis direction as shown in FIG. 6B, so that the connector housing 14 can be displaced relative to the fixing portion 16 in the X-axis direction. Namely, the connector housing 14 can be displaced in the X-axis direction and the Y-axis direction by the elastic deformation of the connecting portions 34. Therefore, even if there is an error in the position of fixing of the fixing portion 16 to the body 10, or in the position of fixing of the mating connector C2 to the panel 12, such an error can be absorbed by the displacement of the connector housing 14, and the two connectors C1 and C2 can be smoothly connected together (that is, the connector terminals of the connector C2 can be smoothly connected respectively to the connector terminals of the connector C1) when the panel 12 is mounted on the body 10.

In this embodiment, the connecting arms 34 and the projected portions 38 of the connector housing 14 are received in the limitation windows 40 in the side wall of the fixing portion 16, and the displacement of the connector housing 14 relative to the fixing portion 16 in a connector-connecting direction (upward-downward direction in FIG. 1) is limited by contact of the connecting arms 34 and the projected portions 38 with the peripheral edges of the limitation windows 40, and therefore the connector housing 14 will not be excessively displaced in the connector-connecting direction by a load applied when fitting the connector terminals together, and hence the connecting arms 34 will not be excessively deformed in this direction, so that there is achieved an advantage that the connecting arms 34 are prevented from damage due to such deformation.

The present invention is not limited to the above embodiment, and for example, the following modifications can be made:

(1) In the above embodiment, although the connecting arm 34 and the projected portion 38 are both received in the associated limitation window 40, one of the two may be received in the limitation window 40, and in this case, also, the displacement can be limited. Further, the displacement limitation means is not limited to the window 40, and for example, limitation projections are formed on the inner surface of the fixing portion 16 at a lower portion thereof, and project toward the connector housing 14, and the displacement of the connector housing 14 can be limited by contact of these limitation projections with the lower surface of the connector housing 14. However, when the cavities for molding the connecting arms 34 are used as the limitation windows 40 as in the above embodiment, there are achieved advantages that the long connecting arms 34 (which can be easily flexed) can be formed without increasing the connector C1 into a large size and that the whole of the connector can be easily molded.

(2) In the above embodiment, although the fixing portion 16 is formed into a frame-like shape, and surrounds the connector housing 14, the fixing portion 16 may be formed into a block-like shape, in which case the connector housing 14 is supported on the upper side of this fixing portion 16 through connecting arms 34. However, when the frame-like fixing portion 16 is used as in the above embodiment, the connector housing 14 is received in the fixing portion 16, and therefore there are achieved advantages that the size of the connector C1 (its size in the connecting direction) can be reduced and that the molding can be effected easily.

(3) In the present invention, each of the connecting portions is not limited to the L-shaped connecting arm 34, but may have any suitable form in so far as it has a first flexing portion extending in a first direction substantially perpendicular to the connector-connecting direction, and a second flexing portion extending in a second direction perpendicular to the first direction.

Advantageous Effects of the Invention

As described above, in the present invention, the fixing portion and the connector housing are integrally connected together through the connecting portions, and the connecting portion is formed into such a shape that it has the first flexing portion and the second flexing portion which extend respectively in the directions substantially perpendicular to each other. Therefore, with the simple construction requiring a reduced number of component parts, the connector housing can be mounted for displacement relative to the fixing portion merely by fixing the fixing portion to the fixing member, and the connector can be smoothly connected to the mating connector.

In one form of the invention, the displacement limitation portions for limiting the displacement of the connector housing in a direction parallel to the direction of connection to the mating connector are provided at the fixing portion. With this construction, the connector housing will not be excessively displaced in the direction parallel to the connector-connecting direction when connecting the connector to the mating connector, so that the connecting portions are prevented from damage due to such displacement.

Preferably, the fixing portion has a frame-like shape, and surrounds the connector housing, and with this construction the overall size of the connector can be reduced since the connector housing is disposed within the fixing portion.

In this case, preferably, the limitation windows are formed in the side wall of the fixing portion, and part of the connector housing or at least part of the connecting portions is received in the limitation window, and with this construction the displacement of the connector housing in the direction parallel to the direction of connection to the mating connector is prevented by contact of the peripheral edge of the limitation window with the connector housing or the connecting portion. With this simple construction, damage to the connecting portion can be prevented.

In this case, the cavities for molding the connecting portions can be used as the limitation windows, respectively, and with this arrangement, the overall construction of the connector can be more simplified, and the molding of the connector can be effected easily.

What is claimed is:

1. A connector for connection to a mating connector in such a manner that said connector is attached to a fixing member, said connector comprising:

a connector housing for connection to said mating connector;

a fixing portion for being attached to said fixing member; and connecting portions interconnecting said connector housing and said fixing portion, wherein said connector housing, said fixing portion and said connecting portions are integrally formed of an elastically-deformable material, and each of said connecting portions has a first flexing portion extending in a first direction substantially perpendicular to a direction of connection of said connector to said mating connector, and a second flexing portion extending in a second direction substantially perpendicular to said direction of connection to said mating connector and said first direction.

2. A connector according to claim 1, wherein said fixing portion has displacement limitation portions for limiting the displacement of said connector housing in a direction parallel to said direction of connection to said mating connector.

3. A connector according to claim 1, wherein said fixing portion has a frame-like shape so as to surround said connector housing.

4. A connector according to claim 2, wherein limitation windows for receiving at least one of said connector housing and said connecting portions are formed in a side wall of said fixing portion, and the displacement of said connector housing in the direction parallel to said direction of connection to said mating connector is prevented by contact of a peripheral edge of said limitation window with the at least one of said connector housing and said connecting portions.

5. A connector according to claim 4, wherein cavities for molding said connecting portions are used as said limitation windows, respectively.

* * * * *